US007671261B1

(12) United States Patent
Momose

(10) Patent No.: US 7,671,261 B1
(45) Date of Patent: Mar. 2, 2010

(54) MUSICAL INSTRUMENT CARRIER AND RELATED METHODS

(75) Inventor: Katsuhiro Momose, Chiba (JP)

(73) Assignee: Pearl Musical Instruments Co., Chiba (JP)

( * ) Notice: Subject to any disclaimer, the term of this patent is extended or adjusted under 35 U.S.C. 154(b) by 0 days.

(21) Appl. No.: 12/343,913

(22) Filed: Dec. 24, 2008

(51) Int. Cl.
*G10D 13/02* (2006.01)

(52) U.S. Cl. ..... 84/421

(58) Field of Classification Search ..... 84/421; 224/265

See application file for complete search history.

(56) References Cited

U.S. PATENT DOCUMENTS

| | | | | |
|---|---|---|---|---|
| 373,873 | A | 11/1887 | Wurlitzer | |
| 1,179,063 | A | 4/1916 | Aldrete | |
| 1,191,425 | A | 7/1916 | Huddle | |
| 4,256,007 | A | 3/1981 | Streit | |
| 4,387,839 | A | 6/1983 | Dranchak | |
| 4,402,441 | A | 9/1983 | Jones et al. | |
| 4,715,293 | A | 12/1987 | Cobbs | |
| 5,076,131 | A | 12/1991 | Patterson | |
| 5,691,492 | A | 11/1997 | May | |
| D388,246 | S | 12/1997 | Patterson | |
| 5,973,247 | A | 10/1999 | Matthews | |
| 6,028,257 | A | 2/2000 | May | |
| 6,323,407 | B1 | 11/2001 | May | |
| 6,329,583 | B1 | 12/2001 | May | |
| 6,403,869 | B2 | 6/2002 | May | |
| 6,450,377 | B1 | 9/2002 | Oriolo | |
| 6,764,231 | B1 | 7/2004 | Shubert | |
| 6,765,140 | B2 | 7/2004 | Crouch | |
| 6,770,805 | B2 | 8/2004 | May | |
| 6,881,886 | B2 | 4/2005 | May | |
| 6,891,100 | B2 | 5/2005 | Crouch | |
| 7,071,401 | B2 | 7/2006 | May | |
| 7,166,790 | B2 | 1/2007 | May | |
| 7,276,653 | B2 * | 10/2007 | Shimada | 84/421 |
| 7,326,842 | B2 | 2/2008 | May | |
| 7,394,008 | B2 | 7/2008 | May | |
| 7,420,110 | B2 | 9/2008 | May | |
| 7,554,024 | B2 * | 6/2009 | Miyajima | 84/421 |
| 2002/0125278 | A1 * | 9/2002 | Wagmild | 224/268 |

OTHER PUBLICATIONS

Slingerland carriers brochure (models 827, 826, 844, 861, 817, 829, 814, 867), p. 74 (1979).

(Continued)

*Primary Examiner*—Kimberly R Lockett
(74) *Attorney, Agent, or Firm*—Berenato & White, LLC

(57) ABSTRACT

A body-supportable musical-instrument carrier featuring a rigid frame, a belly plate, and first and second mounting members is provided. The frame includes a substantially U-shaped intermediate section and end sections at opposite ends of the intermediate section. The intermediate section substantially conforms to shoulder and upper back regions of a user for resting on the shoulder regions and extending across the upper back region of the user in use. The end sections extend substantially parallel to one another for resting in front of a front torso region of the user in use. The first mounting members are mountable on the belly plate and engageable with the end sections, respectively, for securing the belly plate to the frame. The second mounting members are mountable on the belly plate and engageable with a musical instrument for securing the musical instrument to the carrier.

23 Claims, 7 Drawing Sheets

OTHER PUBLICATIONS

Slingerland "New Thin Twirling Scotch Drums by Slingerland", p. 54, (1967).
Ludwig Marching Accessories, p. 82 (1980).
Slingerland "Melodic Percussion", p. 63 (1970).
Ludwig "Carriers and Accessories", p. 62 (1984).

* cited by examiner

MUSICAL INSTRUMENT CARRIER AND RELATED METHODS

FIELD OF THE INVENTION

The present invention relates to body-supportable musical instrument carriers, especially to carriers wearable by a marching band member to support one or more percussion instruments, such as drums, and to permit the marching band member to simultaneously ambulate and play the percussion instrument(s). The present invention also relates to methods of making and using the body-supportable musical instrument carriers.

BACKGROUND OF THE INVENTION

Musical instrument carriers are often necessary or at least desirable to permit a musician to play his or her musical instrument while standing, walking, and/or marching. Musical instrument carriers are especially useful for percussion instruments, such as drums and the like. Functionally, musical instrument carriers are optimally designed to provide comfort and mobility to the user and stability to the musical instrument while retaining the musical instrument in a convenient playing position, typically with both of the user's hands free and unobstructed to play the musical instrument. While some musical instruments can be effectively carried using a neck strap or belt clip secured to the musician, such simplistic carriers are not well adapted for use with certain musical instruments, especially percussion instruments, which are relatively heavy and/or require hands-free stabilization.

SUMMARY OF THE INVENTION

A first aspect of the invention provides a body-supportable musical-instrument carrier featuring a rigid tubular frame, a belly plate, and first and second mounting members. The rigid tubular frame includes a substantially U-shaped intermediate section and first and second end sections at opposite ends of the substantially U-shaped intermediate section, the substantially U-shaped intermediate section substantially conforming in shape to shoulder and upper back regions of a user for resting on the shoulder regions and extending across the upper back region of the user in use. The first and second end sections extend substantially parallel to one another for resting in front of a front torso region of the user in use. The first mounting members are mountable on the belly plate and engageable with the first and second end sections, respectively, for securing the belly plate to the rigid tubular frame. The second mounting members are mountable on the belly plate and engageable with a musical instrument for securing the musical instrument to the body-supportable musical-instrument carrier.

According to a second aspect of the invention, a body-supportable musical-instrument carrier is provided. The carrier features a rigid frame, a belly plate, and first and second mounting members. The rigid frame includes a non-hollow, solid rod having a substantially U-shaped intermediate section and first and second end sections at opposite ends of the substantially U-shaped intermediate section. The substantially U-shaped intermediate section substantially conforms to shoulder and upper back regions of a user for resting on the shoulder regions and extending across the upper back region of the user in use. The first and second end sections extend substantially parallel to one another for resting in front of a front torso region of the user in use. The first mounting members are mountable on the belly plate and engageable with the first and second end sections, respectively, for securing the belly plate to the rigid frame. The second mounting members are mountable on the belly plate and engageable with a musical instrument for securing the musical instrument to the body-supportable musical-instrument carrier.

A third aspect of the invention provides a rigid frame for a body-supportable musical-instrument carrier. The rigid frame features a substantially U-shaped intermediate section and first and second end sections at opposite ends of the substantially U-shaped intermediate section. The substantially U-shaped intermediate section substantially conforms to shoulder and upper back regions of a user for resting on the shoulder regions and extending across the upper back region of the user in use. The first and second end sections extend substantially parallel to one another for resting in front of a front torso region of the user in use.

A fourth aspect of the invention provides a method of supporting a musical instrument on a body of a user. The method features placing a rigid frame including a substantially U-shaped intermediate section and first and second end sections at opposite ends of the substantially U-shaped intermediate section on a user. The substantially U-shaped intermediate section substantially conforms to shoulder and upper back regions of the user and is placed so as to rest on the shoulder regions and extending across the upper back region of the user. The first and second end sections extend substantially parallel to one another and are placed to rest on a front torso region of the user. A height-adjustable belly plate is secured at a selected height to the first and second end sections of the rigid frame. A musical instrument is secured to the belly plate.

Additional aspects of the invention, including apparatus, devices, carriers, systems, kits, combinations, sub-assemblies, and methods of making and using the same, will become apparent upon viewing the accompanying drawings and reading the detailed description below.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

Figure 2:
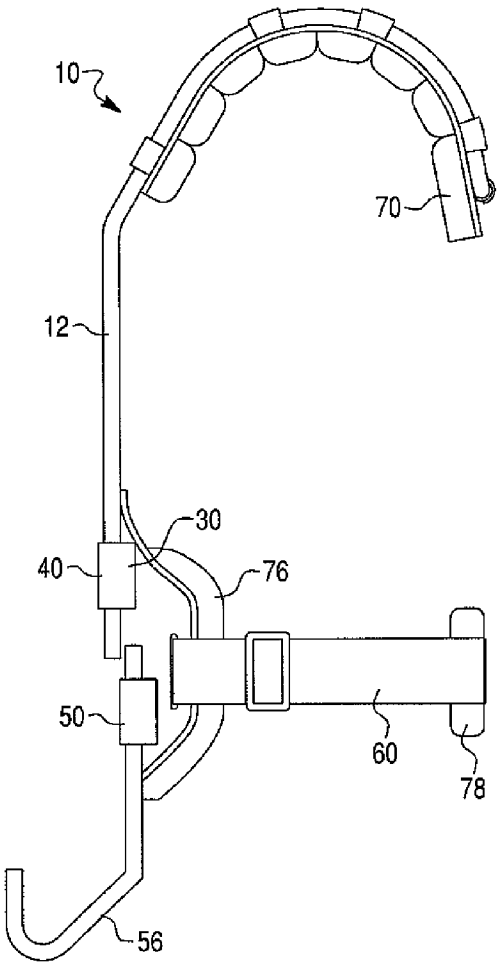
FIG. 2 is a side elevational view of the body-supportable musical-instrument carrier of FIG. 1.

DETAILED DESCRIPTION OF EXEMPLARY EMBODIMENTS AND EXEMPLARY METHODS OF THE INVENTION

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the exemplary embodiments and methods.

Figure 1:
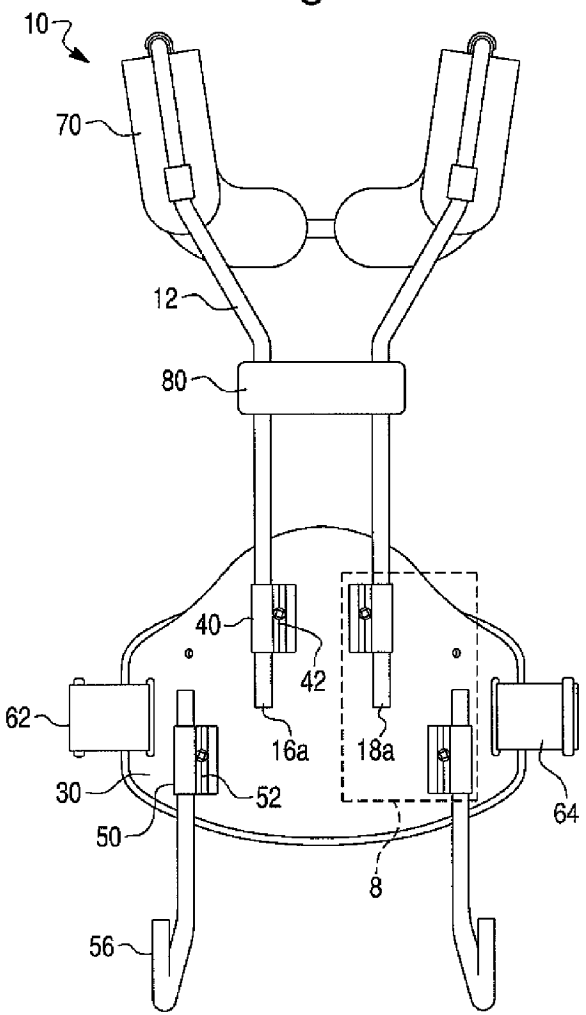
FIG. 1 is a front elevational view of a body-supportable musical-instrument carrier according to a first embodiment of the invention.
Figure 4:
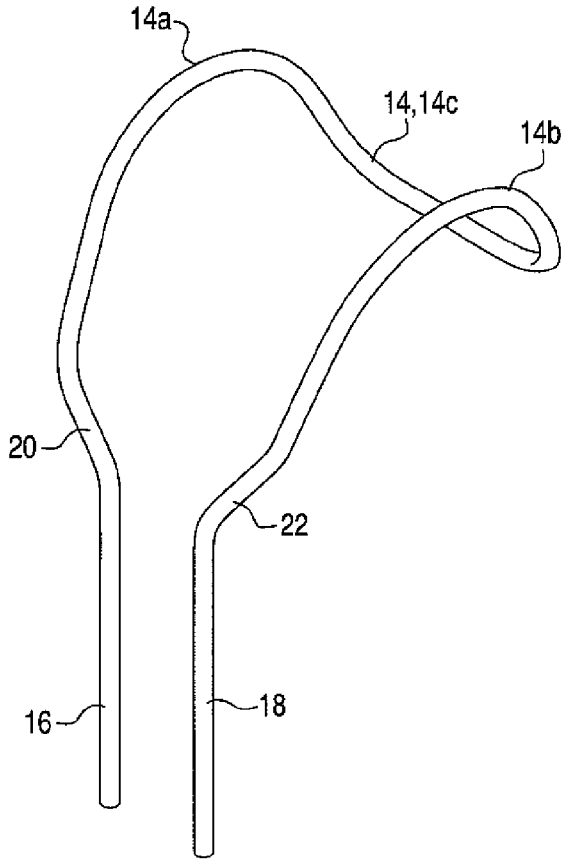
FIG. 4 is a perspective view of a rigid tubular frame of the body-supportable musical-instrument carrier of FIGS. 1 and 2.

A body-supportable musical-instrument carrier is generally designated by reference numeral 10 in FIGS. 1 and 2. The musical instrument carrier 10 includes a rigid tubular frame 12 that is symmetrical. As best shown in FIG. 4, the frame 12 has an intermediate section 14 configured along its length to establish a substantially U-shape in plan view. The substantially U-shaped intermediate section 14 is formed, bent, or otherwise configured to substantially conform in shape over both shoulder regions and across the upper back (optionally including the neck) region of an intended user/wearer of the musical instrument carrier 10. When the musical-instrument carrier 10 is properly worn as intended, arcuate shoulder support areas 14*a*, 14*b* of the substantially U-shaped intermediate section 14 rest on the shoulder regions of the user, and a back or rear area 14*c* of the intermediate section 14 extends across and optionally rests on the upper back (optionally including the neck) region of the user. The opposite ends of the substantially U-shaped intermediate section 14 are angled around the chest area to establish inwardly flared sections 20, 22.

The rigid tubular frame 12 further includes first and second end sections 16, 18 extending substantially parallel relative to one another downward from opposite ends of the substantially U-shaped intermediate section 12, more specifically from the inwardly flared sections 20 and 22, respectively. When the musical-instrument carrier 10 is properly worn by the user, the first and second end sections 16, 18 extend downward in front of a front torso and abdominal region of the user, with the terminal ends 16*a*, 18*a* of the end sections 16, 18 facing the ground.

The rigid tubular frame 12 extends continuously from the terminal end of the first end section 16 to the terminal end of the second end section 18. The rigid tubular frame 12 may have a substantially uniform or varying cross-sectional area and cross-sectional shape over its continuous length. The cross-sectional shape of the rigid tubular frame 12 may be, for example, circular, oval, or polygonal, e.g., rectangular. The rigid tubular frame 12 may be a monolithic member, that is, a unitary singular piece. Alternatively, the rigid tubular frame 12 may comprise a plurality of segments or pieces connectable in end-to-end fashion to form the continuous structure. This segmented embodiment is particularly desirable for enhancing the storability and transportability of the rigid tubular frame 12. The end-to-end connections of this alternative segmented embodiment may be removable (non-permanent), such as segments with telescopic end portions connected to one another via quick-release pins, bolts, force-fitting, clamps, etc. Alternatively, the end-to-end connections may be made permanent, such as by welding.

Making the rigid tubular frame 12 of a light weight material, such as a metal or composite material, desirably reduces the load on the user. Aluminum is an example of a metal that may be extruded, bent, or otherwise formed into the rigid tubular frame 12. A combination of different materials may be selected. The weight of the rigid tubular frame 12 may be reduced by forming the tubular frame 12 as a hollow construction. Each of the end section 16, 18 may be equipped with an end fitting (not shown) to cover and conceal sharp edges of the ends 16*a*, 18*a* of the tubular frame 12 for safety. Alternatively, the rigid tubular frame 12 may be filled with filler. Alternatively, the rigid tubular frame 12 may replaced with a solid non-hollow rod that, except for being non-hollow, may be shaped and have the features described herein with respect to tubular frame 12.

Figure 5:
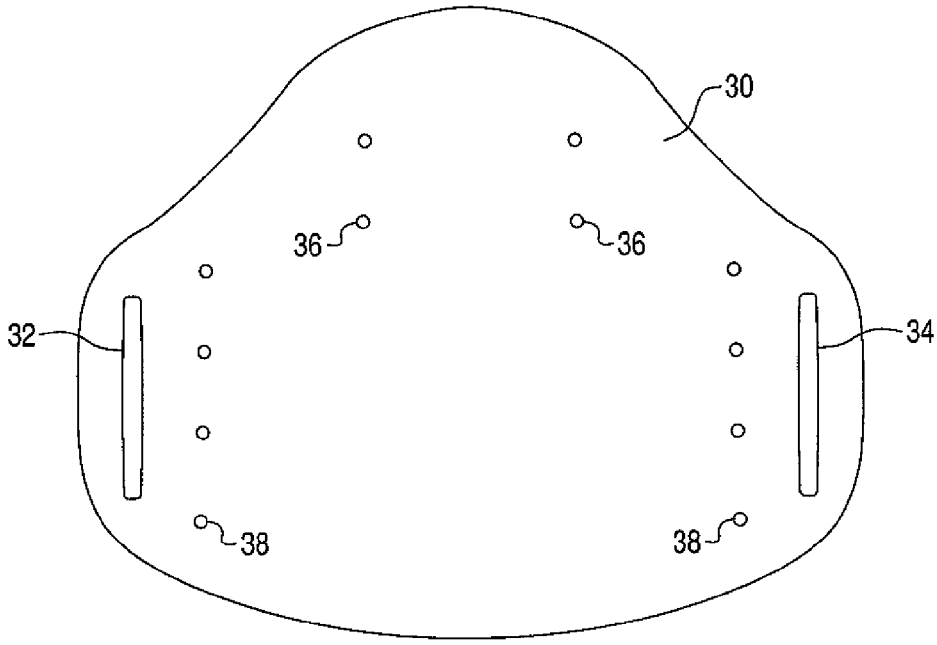
FIG. 5 is an enlarged, front elevational view of the belly plate of the body-supportable musical-instrument carrier of FIGS. 1 and 2.

The musical-instrument carrier 10 further includes a belly plate 30. As best shown in FIG. 5. In the illustrated embodiment the belly plate 30 has a substantially pentagonal shape when viewed in plan. It should be understood that the belly plate 30 may be configured to have alternative shapes, such as a rectangle with sharp or rounded corners, an oval, etc. The belly plate 30 also is preferably made of a relatively light weight material, such as a metal or composite material.

As best shown in FIG. 5, the belly plate 30 possesses belt-receiving slots 32, 34 adjacent its left and right side edges. First mounting apertures 36 are positioned symmetrically (relative to a vertical symmetrical axis of the belly plate 30) at identical heights to one another. The first mounting apertures 36 comprise a left column of circular holes on one side of the belly plate 30 and a right column of circular holes on the other side of the belly plate 30. Second mounting apertures 38 are likewise formed in and symmetrically positioned relative to one another. The second mounting apertures 38 comprise a left column of circular holes on one side of the belly plate 30 and a right column of circular holes on the other side of the belly plate. The first mounting apertures 36 are positioned above and inwardly (towards the vertical symmetrical axis of the belly plate 30) relative to the second mounting apertures 38. It should be understood, however, that the belly plate 30 may be provided with different arrangements and quantities of mounting apertures 36, 38. For example, left and right columns of multiple mounting apertures 36 and/or 38 may be provided as a single left mounting aperture and a single right mounting aperture. The columns of mounting apertures 36 and 38 facilitate height adjustment of the musical instrument on the carrier 10. Alternatively, apertures 36, 38 may be shaped as elongate slots for facilitating continuous height adjustment of the musical instrument.

Figure 8:
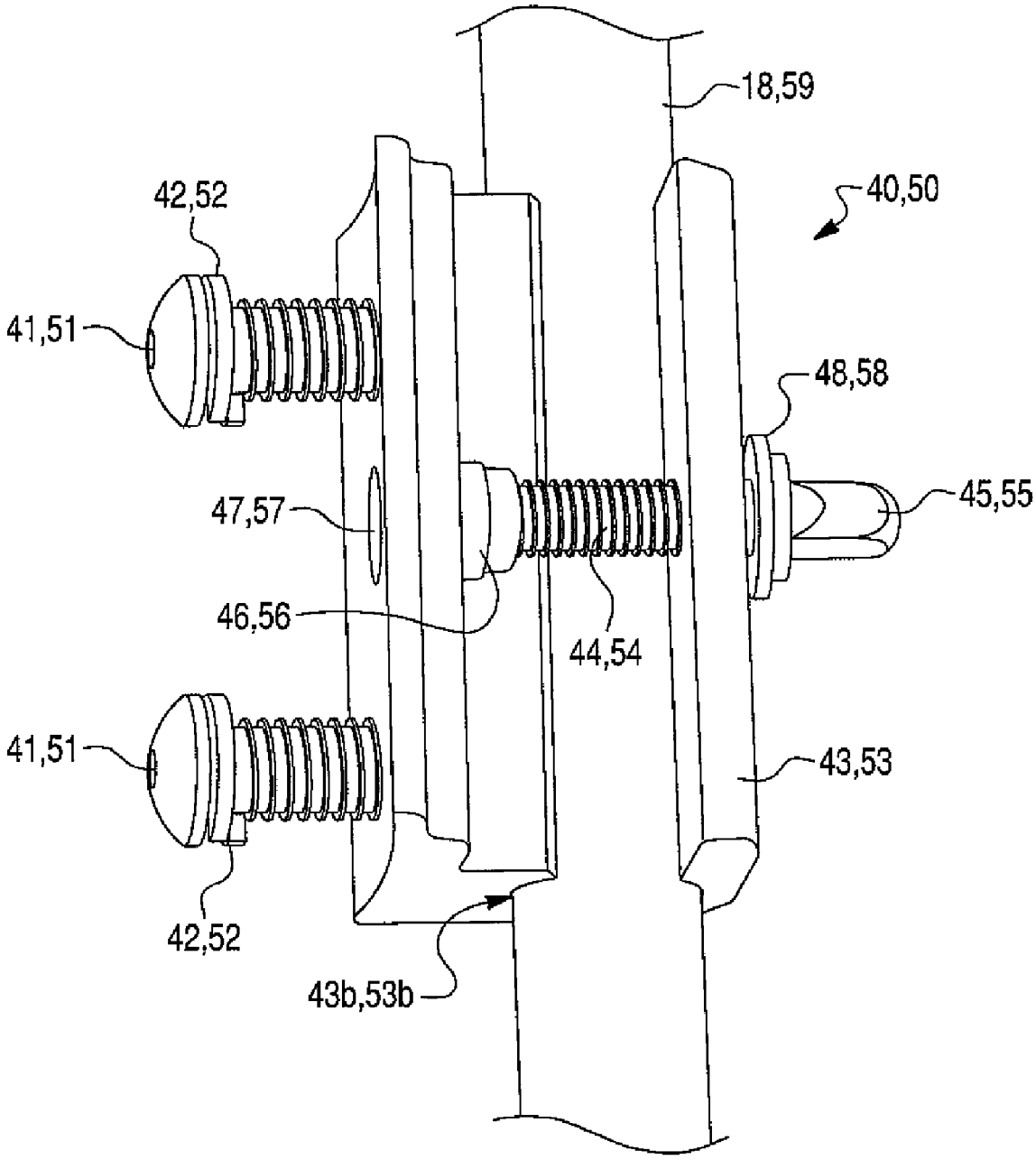
FIG. 8 is a disassembled, fragmented side view of mounting members of the body-supportable music instrument carrier of FIGS. 1 and 2.

Each of the first mounting members 40 is mountable to the belly plate 30 by inserting the shafts of a pair of screws 41 through corresponding ones of the first mounting apertures 36. As best shown in FIG. 8, the shafts of the screws 41 carry lock washers 42. The screw 41 shafts are threadingly received in threaded holes (not shown) in the rear surface of a first receptacle body (also referred to as a bracket) 43.

Figure 9:
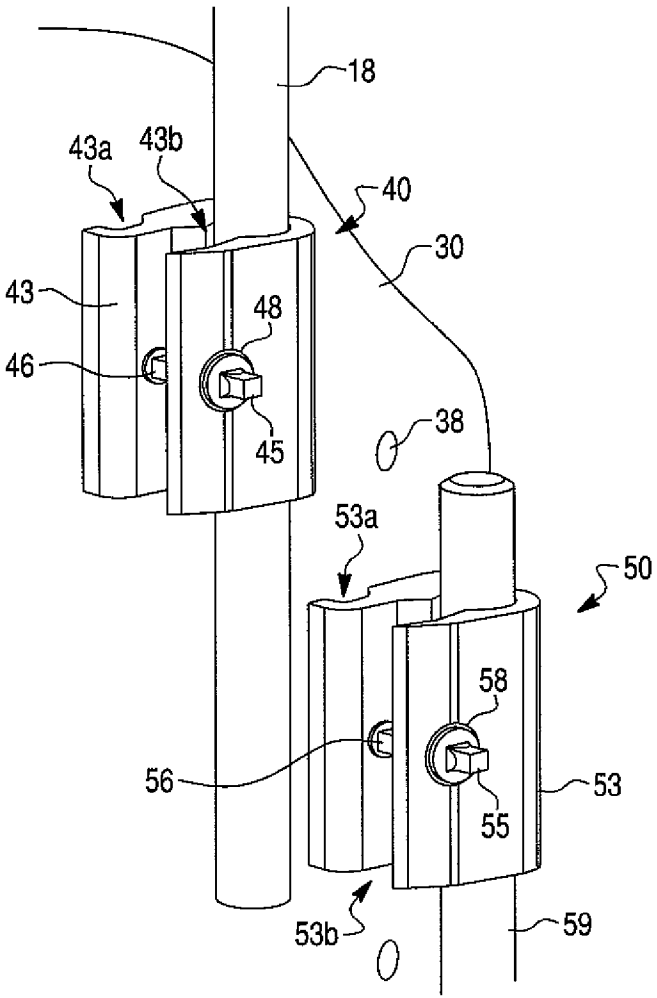
FIG. 9 is an enlarged fragmented perspective view of the body-supportable musical instrument carrier of FIGS. 1 and 2.

Each of first mounting members 40 further includes a first bolt 44 having a first square head 45, and a first nut 46. The first nut 46 is press-fitted into a rear arm of the first receptacle body (bracket) 43. As best shown in FIG. 9, which is an enlarged view of the area 8 of FIG. 1, the rear surface of the first receptacle body 43 may be provided with a shallow groove 43*a* for accommodating the rear end 47 of the first nut 46, i.e., so that any rearwardly protruding portion of the rear end 47 does not interfere with a flush interface between the rear surface of the first receptacle body 43 and the front surface of the belly plate 30. The first receptacle body 43 is mated with the first bolt 44 by inserting the shaft of the first bolt 44 through a front through hole (unnumbered) in a front arm of the first receptacle body 43. The front through hole is aligned with the first nut 46. A washer 48 may be carried on the first bolt 44 adjacent to the head 45. The shaft of the first bolt 44 is threadedly engaged with the first nut 46 and can be rotatably loosened and tightened using a suitable instrument, such as a key that mates with head 45.

The front and rear arms of each of the first receptacle bodies (brackets) 43 form a substantially vertically oriented open channel 43*b* that is configured and positioned to slidingly receive a respective end section 16, 18 of the rigid tubular frame 12. Tightening the first bolts 44 flexes the first receptacle body 43 into a clamping position, i.e., reducing the cross-sectional area of the channel 43*b* between the arms, to stably secure the first receptacle body 43 (and hence the belly plate 30 that is attached thereto via screws 41) to the rigid tubular frame 12. Loosening the first bolts 44 loosens this grip and allows the belly plate 30 to be moved by the user upward or downward relative to the rigid tubular frame 12 into a desired position. The square-shaped heads 45 of the first bolts 44 may be tightened and loosened by a key (not shown) or other instrument controlled by the user.

It should be understood that the first bolts 44 and the first nuts 46 as well as other features of the first mounting members 40 may undertake other forms, such as quick-release pins, screws, clamps, tightening devices, components thereof, etc. Continuous height adjustability by which the first bolts 44 can secure the first receptacle bodies 43 at any location along the length of the end sections 16, 18 increases height adjustability selection. As an alternative embodiment, the end sections 16, 18 may be provided with one or more spaced holes that are alignable with fasteners such as a quick release pin or bolt for attaining interval height adjustability between the belly plate 30 and the rigid tubular frame 12.

The carrier 10 also includes second mounting members 50 that are virtually identical to the first mounting members 40. Because of the virtual identity between members 40 and 50, FIG. 8 includes reference numerals to corresponding parts of the second mounting member 50. Turning again to FIG. 8, the second mounting members 50 are mountable on the belly plate 30 in a manner similar to the first mounting members 40 described above. Each of the second mounting members 50 is mountable to the belly plate 30 by inserting a pair of screws 51 through corresponding ones of the second mounting apertures 38. The shafts of the screws 51 carry lock washers 52. The screw 51 shafts are received in threaded holes (not shown) in the rear surface of a second receptacle body (also referred to as a bracket) 53.

Again referring to FIG. 8, each of second mounting members 50 further includes a second bolt 54 having a second square head 55, and a second nut 56. The second nut 56 is press-fitted into a rear arm of the second receptacle body (bracket 53). Referring to FIG. 9, the second receptacle body 53 may be provided with a shallow groove 53*a* for accommodating the rear end 57 of the second nut 56, i.e., so that any rearwardly protruding portion of the rear end 57 does not interfere with the flush interface between the rear surface of the second receptacle body 53 and the front surface of the belly plate 30. The second receptacle body 53 is mated with the second bolt 54 by inserting the shaft of the second bolt 54 through a front through hole (unnumbered) of a front arm of the second receptacle body 53. The front through hole is aligned with the second nut 56. A washer 58 may be carried on the second bolt 54 adjacent to the head 55. The shaft of the second bolt 54 is threadingly engaged with the second nut 56 and may be rotatably loosened and tightened using a key or other instrument that mates with head 55.

Each of the second receptacle bodies (brackets) 53 has a substantially vertically oriented open channel 53*b* that is configured and positioned to slidingly receive a longer leg of a respective J-rod 59. Tightening the second bolts 54 flexes the second receptacle body 53 into a clamping position, reducing the cross-sectional area of the channel 53*b* between the front and rear arms of the second receptacle bracket 53. The J-rod 59 is thereby gripped and stably secured between the opposite arms of the second receptacle body 53 (and hence to the belly plate 30 that is attached to body 53 via screws 51). Loosening the second bolts 54 releases the J-rods 59 from clamping engagement, allowing the user to manually move the J-rods 59 upward or downward relative to the belly plate 30 into a desired playing position. The J-rods 59 are retained in the desired playing position by then tightening the second bolts 54 until the J-rods 59 are clamped between the opposite arms of the second receptacle bracket 53.

It should be understood that the second bolts 54 and second nuts 56 as well as other features of the second mounting members 50 may undertake other forms, such as quick-release pins, screws, clamps, tightening devices, components thereof, etc. Continuous height adjustability by which the J-rods 59 can be secured at any location along their length to the second mounting members 50 increases height adjustability selection. As an alternative embodiment, the J-rods 59 may be provided with one or more spaced holes that are alignable with fasteners such as a quick release pin or bolt for attaining interval height adjustability between the belly plate 30 and the J-rods 59.

The shorter legs of the J-rods 59 are adapted to engage one or more musical instruments, especially a percussion instrument such as a drum in manners well known in the art and any future manner yet to be discovered. The J-rods 59 may be of a solid, non-hollow construction or may have a tubular hollow or filled construction, for example.

The second bolts (fasteners) 54 may be the same or different than the first bolts (fasteners) 44 described above. Alternatively, the second bolts (fasteners) 54 and other parts of the second mounting members 50 may comprise, for example, clamps, quick-release pins, screws, tightening devices, components thereof, etc. The second bolts (fasteners) 54 may allow for continuous or interval height adjustment of the J-rods 59 (and consequently the mounted musical instrument) relative to the belly plate 30.

It should be understood that the first mounting members 40 and the second mounting members 50 may possess different shapes and may be mounted on the belly plate 30 in alternative manners to those described above. The mounting members 40, 50 may, for example, be permanently welded or bonded to the belly plate 30. The first and second mounting members 40, 50 are depicted as discrete members with respect to one another. It should be understood that a pair or other plurality of the first and second receptacle bodies 43, 53 may be constructed or formed as a monolithic structure, e.g., a singular unitary body.

The mounting members 40, 50 can be made of light weight materials such as metals and/or composites to lessen the weight of the musical-instrument carrier 10, thereby improving comfort to the user and easing the weight load, especially over prolonged periods of use.

Figure 10:
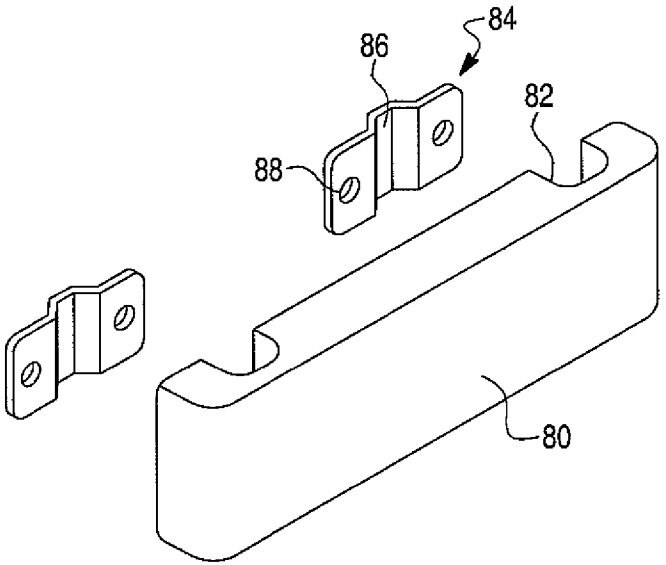
FIG. 10 is a perspective view of a front connecting plate and brackets of the body-supportable musical-instrument carrier of FIGS. 1 and 2.

As best illustrated in FIG. 1, the first embodied carrier 10 includes a plate 80 extending between and connecting the first and second end sections 16, 18 of the rigid tubular frame 12. Referring to FIG. 10, the rear of the plate 80 includes vertically oriented semi-cylindrical channels 82 for receiving semi-cylindrical cross-sections of the first and second end sections 16, 18, respectively. Brackets 84 that are shaped, e.g., stamped, to possess semi-cylindrical arcuate portions 86 are attachable to the back side of the plate 80 to extend across the channels 82. The arcuate portions 86 of the brackets 84 and the channels 82 of the plate 80 collectively form cylindrical passages through which the first and second end sections 16, 18 extend vertically. The brackets 84 are provided with holes 88 which align with corresponding holes (not shown) in the rear of the plate 80. Fasteners (not shown) such as screws or the like are inserted through the holes 88 and into the rear of the bracket 80 and tightened to clamp to plate 80 to the first and second end sections 16, 18 of the carrier 12.

The plate 80 is primarily intended as a signage area for advertisement and the like, e.g., to place the name of the carrier manufacturer or the name of the band or owner of the carrier 10. Secondarily, the plate 80 and brackets 84 may contribute structural stability to the frame 12.

According to certain embodiments of the invention, the musical-instrument carrier 10 may further include a flexible belt 60 connected to the belly plate 30 and extending around the lower back region of the user for improving instrument stability and weight distribution. In the embodiment shown in FIG. 1, opposite belt ends 62, 64 of the flexible belt 60 pass through the belt-receiving slots 32, 34, respectively, at the opposite side edges of the belly plate 30. The first belt end 62 is removably connected to the belly plate 30 at slot 32 using a suitable fastener, e.g., Velcro. The first belt end 62 of the belt 60 alternatively may be fixedly and permanently connected to the belly plate 30 at slot 32, for example, by looping the first belt end 62 through the slot 32 and sewing the belt end 62 to itself. The second belt end 64 is slidable through the slot 34 by the user to tighten and loosen the belt 60 about the lower back region of the user. The second belt end 64 is provided with a fastener for retaining the belt 60 at its desired tightness. Buckles and Velcro are examples of adjustable fasteners for retaining the belt tightness. Alternatively, both the first and second ends of the belt 60 may be adjustable relative to their respective slots 32, 34.

Figure 3:
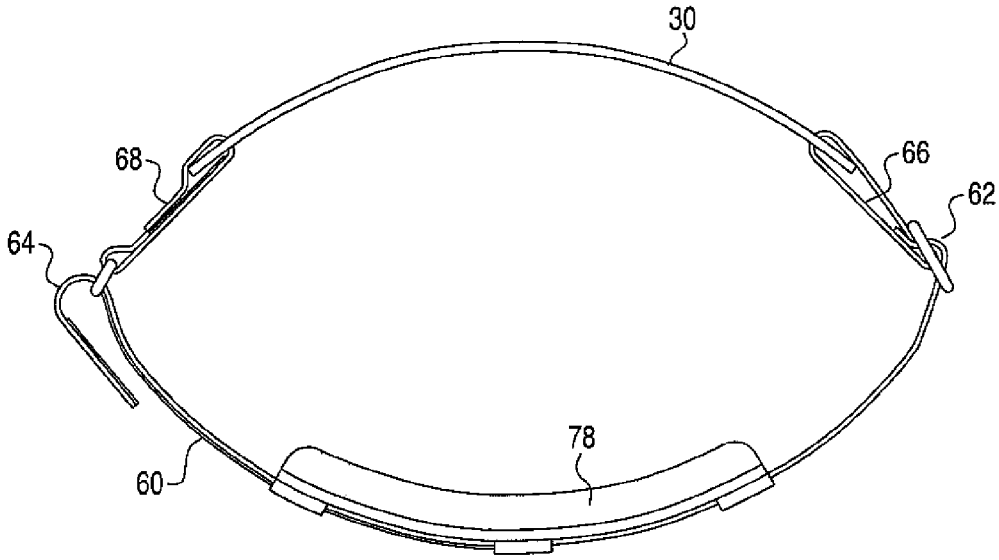
FIG. 3 is an overhead view of a belly plate and flexible belt of the body-supportable musical-instrument carrier of FIGS. 1 and 2, modified to including linking members to connected the flexible belt to the belly plate.

In a slightly modified embodiment shown in FIG. 3, linking members 66 and 68 connect the first and second ends 62, 64 of the flexible belt 60 to the slots 32, 34, respectively.

Figure 6:
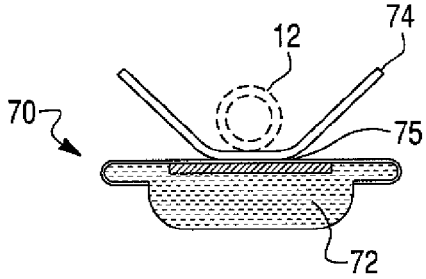
FIG. 6 is an enlarged cross-sectional view of a shoulder pad of the body-supportable musical instrument carrier of FIGS. 1 and 2.
Figure 7:
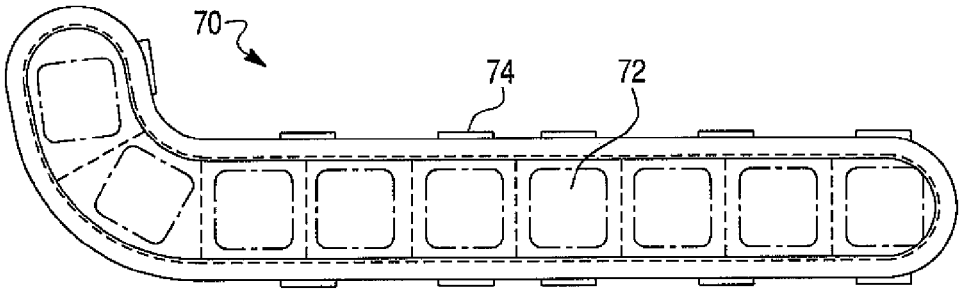
FIG. 7 is an enlarged view of the shoulder pad of FIG. 6 connected to the rigid tubular frame.

The musical-instrument carrier 10 may further include cushions for enhancing comfort to the user. In the illustrated embodiment, shoulder cushions 70 underlie the shoulder support and back areas of the substantially U-shaped intermediate section 14 of the rigid tubular frame 12. A single cushion or multiple cushions may be used to protect the shoulder and back areas of the user. As best shown in FIGS. 1 and 7, the shoulder cushion(s) 70 may be shaped or arranged to conform to the contour of the rigid tubular frame 12. The shoulder cushions 70 and other cushions described herein may include foam-filled pads 72. As best shown in FIG. 6, the shoulder cushions 70 are removably attached to the rigid tubular frame 12 using, for example, Velcro straps 74 or other attachments for allowing quick removal of the shoulder cushions 70 for cleaning and replacement purposes. The Velcro straps 74 are joined to the shoulder cushions 70A at plate 75 (e.g., plastic) using any suitable fastening or bonding means. Although not shown, similar cushions may underlie and be attached to the first and second end section 16, 18 of the rigid tubular frame 12 and elsewhere.

Additionally, an abdominal cushion 76 is shown secured to the rear surface of the belly plate 30 in FIG. 2. As best shown in FIG. 3, a back cushion 78 is secured to the portion of the belt 60 that comes into contact with the lower back area of the user. The abdominal cushion 76 and back cushion 78 may be detachable from the belly plate 30 and the belt 60, respectively, for cleaning and replacement purposes.

Figure 11:
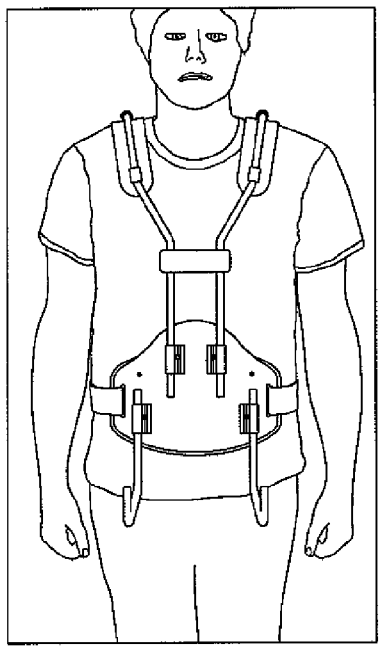
FIG. 11 is a front view of a body-supportable musical-instrument carrier according to another embodiment of the invention worn by a musical instrument player or user.
Figure 12:
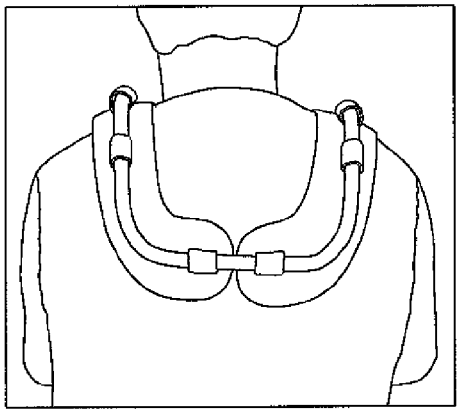
FIG. 12 is a rear view of the body-supportable musical-instrument carrier of FIG. 11 shown across the upper back of the player/user.

Application of the carrier 10 to a user for supporting a musical instrument will now be described with reference to FIGS. 11-13, which depict an embodiment substantially identical to the first embodiment described above, but omit plate 80. To apply the carrier 10 to a user, the rigid tubular frame 12 is slipped over the head of the user to rest the substantially U-shaped intermediate section 14 on the shoulder regions and across the upper back region of the user, as best shown in FIGS. 11 and 12. The first and second end sections 16, 18 extend substantially parallel to one another in front of the front torso region of the user when the frame 12 is properly positioned. The height-adjustable belly plate 30 is secured to the first and second end sections 16, 18 of the rigid tubular frame 12 as follows. The first mounting members 40 are engaged to the first mounting apertures 36 of the belly plate 30 using screws 41 and lock washers 42. The opposite ends of the frame 12 are slid into the respective first receptacle bodies 43 of the first mounting members 40. The belly plate 30 is raised to its desired height along the length of the first and second end sections 16, 18 of the frame 12, and the first bolts (fasteners) 44 are tightened or otherwise actuated to secure the belly plate 30 to rigid tubular frame 12 at the desired height. It should be understood that attachment of the belly plate 30 to the mounts 40 and 50 and attachment of the belly plate 30 to the rigid tubular frame 12 may be performed before or after the frame 12 is placed on the user.

Figure 13:
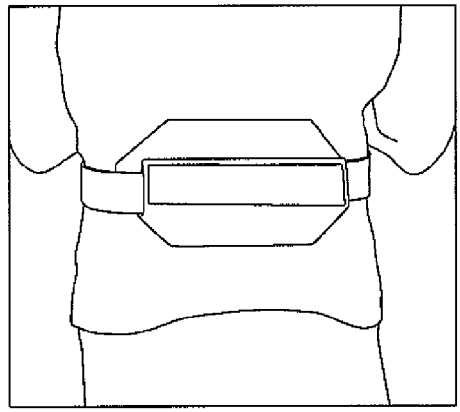
FIG. 13 is a rear view of the body-supportable musical-instrument carrier of FIG. 11 shown across the lower back of the player/user.

As best shown in FIG. 13, the flexible belt 60 is wrapped around the lower back region of the user. The adjustable second belt end 64 is slid through the slot 34 by the user to tighten and loosen the belt 60. A fastener, such as a buckle or Velcro, at the second belt end 64 retains the belt 60 at its selected tightness.

The second mounting member 50 are engaged to a selected pair of the second mounting apertures 38 of the belly plate 30 using screws 51 and lock washers 52. The longer legs of the J-rods 59 are slid into their respective second receptacle bodies 53. The J-rods 59 are placed at their desired height and the second bolts (fasteners) 54 are tightened or otherwise actuated to secure the J-rods 59 to the second receptacle bodies 53, and consequently the belly plate 30. One or more musical instruments, e.g., a drum with a horizontal playing surface, is/are mounted on the J-rods 59 in a secure and stable manner.

Height adjustment of the musical instrument(s) may be accomplished using one or more of the adjustability features described above. Height adjustment is implemented by any one or more of the following: (a) slidingly positioning and clamping the end sections 16, 18 of the rigid frame 12 in the first mounting members 40 to alter the height of the belly plate 30 relative to the frame 12, (b) selecting from the apertures 36, 38 in which to mount the first and second mounting members 40, 50, respectively, and/or (c) slidingly locating and clamping the J-rods 59 at a desired height in the second receptacle bodies 53 of the second mounting members 50. The multiple height adjustment connections of the musical-instrument carrier 12 increase the overall height adjustability range of the musical instrument(s) on the carrier 12.

Figure 15:
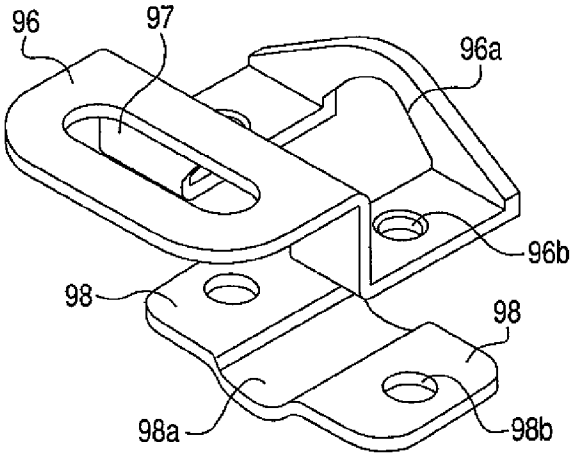
FIG. 15 is perspective disassembled view of shoulder harnesses of an upper support mechanism of the carrier embodied in FIG. 14.
Figure 14:
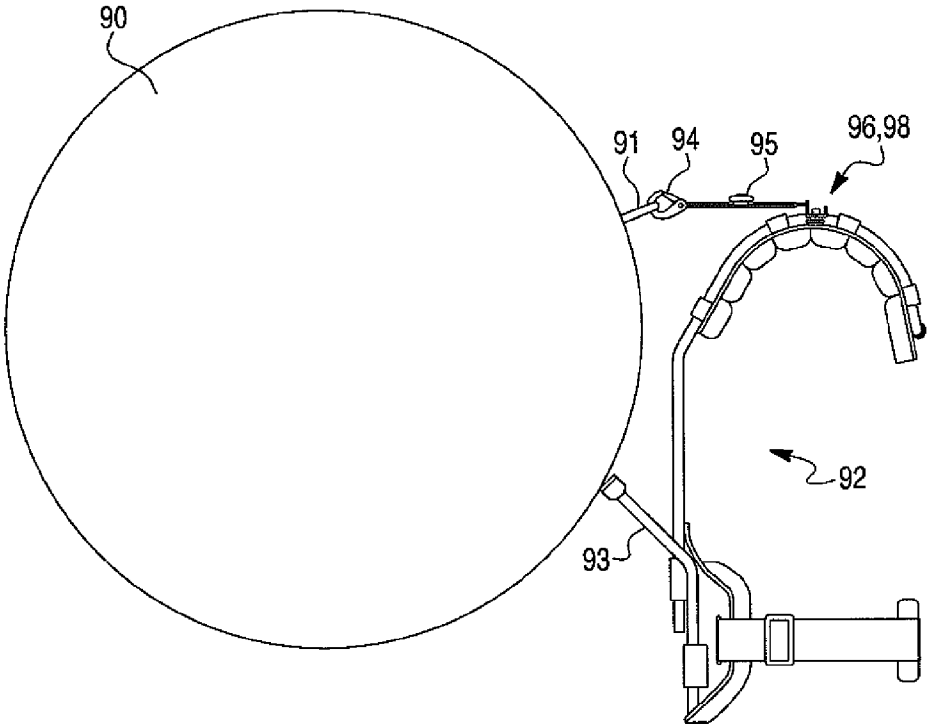
FIG. 14 is a side view of a body-supportable musical-instrument carrier according to another embodiment of the invention for carrying a bass drum.

FIGS. 14 and 15 illustrate another embodiment in which a carrier 92 is used to support a percussion instrument with one or more vertically oriented playing surfaces, such as a bass drum 90. The carrier 92 is generally identical to the first embodiment described above. In the interest of brevity, the following description focuses on the differences between the carrier 92 and the carrier 12, and like reference numerals are used to describe parts/components that are identical in the carriers 12 and 92. The carrier 92 includes first and second rod-like lower instrument contact members 93 which replace the J-rods 59 of the above embodiment. The contact members 93 are each bent at an obtuse angle. The lower legs of the contact members 93 are substantially vertically oriented when received in the receptacles 53*b* of the second mounting members 50. The terminal ends of the upper legs of the contact members 93 abut against the outer annular body of the bass drum 90.

The carrier 92 also includes an upper attachment mechanism including a clasp 94 which detachably engages an eyebolt 91 or other structure of the bass drum 90. One or more straps 95 connect to or pass through the clasp 94. The strap(s) 95 may be length adjustable, e.g., the strap(s) 95 may possess a buckle slide. Harness bracket sets attach the opposite ends of the strap(s) 95 to the arcuate shoulder support areas 14*a*, 14*b*, respectively. Each harness bracket set includes a first harness bracket 96 having a slot 97 through which a respective end of the strap 95 is fed and secured, and a second harness bracket 98 which cooperates with the first harness bracket 96 to clamp the harness bracket set to the arcuate shoulder support areas 14*a*, 14*b* of the rigid tubular frame 12. Semi-cylindrical arcuate channels 96*a*, 98*a* of the harness brackets 96, 98 face one another and provide a cylindrical passage for mating with a respective shoulder support area 14*a* or 14*b* of the frame 12. Through holes 96*b*, 98*b* of the harness brackets 96, 98 align with one another and receive a fastener (not shown), such as a bolt or screw, for mating the harness brackets 96 and 98 to one another and tightening the bracket sets on the frame 12. The weight of the bass drum 90 pulls the strap 95 taut.

Advantageously, the invention as embodied in certain exemplary embodiments described herein provides a carrier that is easy to use and quick to assemble. The relatively small number of components makes the carrier inexpensive to produce and reduces the weight penalty during use, particularly in the hollow construction embodiments. These advantages allow the user to preserve his or her energy and march/play for longer periods of time. As embodied in certain exemplary embodiments described herein, the carrier provides multiple points of instrument height adjustment for increasing the overall versatility of the carrier, making it suitable for tall and short users alike. The exemplary carrier stably retains the mounted musical instrument(s) in a fixed position while freeing up both hands of the user to play the musical instrument(s). The exemplary carrier is constructed to permit the user to put on, remove, and fit the exemplary carrier with minimal assistance and difficulty.

The foregoing detailed description of the certain exemplary embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims and their appropriate equivalents.

What is claimed is:

1. A body-supportable musical-instrument carrier, comprising:

a rigid tubular frame comprising a substantially U-shaped intermediate section and first and second end sections at opposite ends of the substantially U-shaped intermediate section, the substantially U-shaped intermediate section substantially conforming to shoulder and upper back regions of a user for resting on the shoulder regions and extending across the upper back region of the user in use, the first and second end sections extending downward substantially parallel to one another for resting in front of a front torso region, including along an abdomen region, of the user in use;

a belly plate;

first mounting members mountable on the belly plate and engageable with the first and second end sections, respectively, of the rigid tubular frame for securing the belly plate to the rigid tubular frame; and second mounting members mountable on the belly plate and engageable with a musical instrument for securing the musical instrument to the body-supportable musical-instrument carrier.

2. A body-supportable musical-instrument carrier according to claim 1, wherein the rigid tubular frame, including the intermediate and first and second end sections collectively, constitutes a continuous monolithic structure.

3. A body-supportable musical-instrument carrier according to claim 1, wherein the rigid tubular frame comprises a substantially constant cross section along an entire length thereof.

4. A body-supportable musical-instrument carrier according to claim 1, wherein the rigid tubular frame has a hollow, non-filled construction.

5. A body-supportable musical-instrument carrier according to claim 1, wherein the substantially U-shaped intermediate section comprises inwardly flared regions adjacent to the downwardly extending end sections to position the first and second end sections closer to one another.

6. A body-supportable musical-instrument carrier according to claim 1, wherein the belly plate has a substantially pentagonal shape.

7. A body-supportable musical-instrument carrier according to claim 1, wherein the first mounting members each comprise a respective receptacle for slidingly receiving a respective one of the first and second end sections to permit height adjustment of the belly plate relative to the rigid frame, and a respective fastener for securing the belly plate to the respective one of the first and second end sections at a selected height relative to the rigid frame.

8. A body-supportable musical-instrument carrier according to claim 1, wherein the second mounting members each comprise a respective J-rod engageable with the musical instrument, a receptive receptacle for slidingly receiving the J-rod, and a respective fastener for engaging the respective J-rod at a selected height for permitting height adjustment of the J-rod relative to the belly plate.

9. A body-supportable musical-instrument carrier according to claim 1, further comprising at least one upper cushion underlying the substantially U-shaped intermediate section of the rigid frame.

10. A body-supportable musical-instrument carrier according to claim 1, further comprising at least one lower cushion underlying the belly plate.

11. A body-supportable musical-instrument carrier according to claim 1, further comprising a flexible belt connectable to the opposite side edges of the belly plate for wrapping around a lower back region of the user in use.

12. A body-supportable musical-instrument carrier, comprising:

a rigid frame comprising a non-hollow, solid rod having a substantially U-shaped intermediate section and first and second end sections at opposite ends of the substantially U-shaped intermediate section, the substantially U-shaped intermediate section substantially conforming to shoulder and upper back regions of a user for resting on the shoulder regions and extending across the upper back region of the user in use, the first and second end sections extending downward substantially parallel to one another for resting in front of a front torso region, including along an abdomen region, of the user in use;

a belly plate;

first mounting members mountable on the belly plate and engageable with the first and second end sections, respectively, of the rigid frame for securing the belly plate to the rigid frame; and second mounting members mountable on the belly plate and engageable with a musical instrument for securing the musical instrument to the body-supportable musical-instrument carrier.

13. A body-supportable musical-instrument carrier according to claim 12, wherein the rigid frame, including the intermediate and first and second end sections collectively, constitutes a continuous monolithic structure.

14. A body-supportable musical-instrument carrier according to claim 12, wherein the rigid frame comprises a substantially constant cross section along an entire length thereof.

15. A body-supportable musical-instrument carrier according to claim 12, wherein the substantially U-shaped intermediate section comprises inwardly flared regions adjacent to the downwardly extending end sections to position the first and second end sections closer to one another.

16. A body-supportable musical-instrument carrier according to claim 12, wherein the belly plate has a substantially pentagonal shape.

17. A body-supportable musical-instrument carrier according to claim 12, wherein the first mounting members each comprise a respective receptacle for slidingly receiving a respective one of the first and second end sections to permit height adjustment of the belly plate relative to the rigid frame, and a respective fastener for securing the belly plate to the respective one of the first and second end sections at a selected height relative to the rigid frame.

18. A body-supportable musical-instrument carrier according to claim 12, wherein the second mounting members each comprise a respective J-rod engageable with the musical instrument, a receptive receptacle for slidingly receiving the J-rod, and a respective fastener for engaging the respective J-rod at a selected height for permitting height adjustment of the J-rod relative to the belly plate.

19. A body-supportable musical-instrument carrier according to claim 12, further comprising a flexible belt connectable to opposite side edges of the belly plate for wrapping around a lower back region of the user in use.

20. A body-supportable musical-instrument carrier according to claim 19, further comprising a back cushion secured to the flexible belt for resting against the lower back region of the user in use.

21. A rigid frame for a body-supportable musical-instrument carrier, the rigid frame comprising a substantially U-shaped intermediate section and first and second end sections at opposite ends of the substantially U-shaped intermediate section, the substantially U-shaped intermediate section substantially conforming to shoulder and upper back regions of a user for resting on the shoulder regions and extending across the upper back region of the user in use, the first and second end sections extending downward substantially parallel to one another for resting in front of a front torso region, including along an abdomen region, of the user in use.

22. A method of supporting a musical instrument on a body of a user, the method comprising:

placing a rigid frame comprising a substantially U-shaped intermediate section and first and second end sections at opposite ends of the substantially U-shaped intermediate section on shoulder and upper back regions of a user, the substantially U-shaped intermediate section substantially conforming to and placed so as to rest on the shoulder regions and extend across the upper back region of the user, the first and second end sections extending downward substantially parallel to one another so as to be positioned in front of a front torso region, including along an abdomen region, of the user;

securing a height-adjustable belly plate at a selected height to the first and second end sections of the rigid frame; and securing a musical instrument to the belly plate.

23. A continuous monolithic rigid frame for a body-supportable musical-instrument carrier, the monolithic rigid frame comprising a substantially U-shaped intermediate section and first and second end sections at opposite ends of the substantially U-shaped intermediate section, the substantially U-shaped intermediate section substantially conforming to shoulder and upper back regions of a user for resting on the shoulder regions and extending across the upper back region of the user in use, the first and second end sections extending substantially parallel to one another for resting in front of a front torso region of the user in use.

* * * * *